US009312639B2

(12) United States Patent
Vinther et al.

(10) Patent No.: US 9,312,639 B2
(45) **Date of Patent: *Apr. 12, 2016**

(54) CONTROLLED-IMPEDANCE CABLE TERMINATION WITH COMPENSATION FOR CABLE EXPANSION AND CONTRACTION

(71) Applicant: Ardent Concepts, Inc., Seabrook, NH (US)

(72) Inventors: Gordon A Vinther, Seabrook, NH (US); Sergio Diaz, Cambridge, MA (US)

(73) Assignee: Ardent Concepts, Inc., Seabrook, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/686,206

(22) Filed: Apr. 14, 2015

(65) Prior Publication Data

US 2015/0295359 A1 Oct. 15, 2015

Related U.S. Application Data

(63) Continuation-in-part of application No. 14/534,241, filed on Nov. 6, 2014, now Pat. No. 9,160,151.

(60) Provisional application No. 61/980,040, filed on Apr. 15, 2014.

(51) Int. Cl.
*H01R 12/00* (2006.01)
*H01R 13/6473* (2011.01)
(Continued)

(52) U.S. Cl.
CPC ..... *H01R 13/6473* (2013.01); *H01R 12/714* (2013.01); *H01R 13/6477* (2013.01); *H01R9/032* (2013.01); *H01R 12/79* (2013.01); *H01R 13/2421* (2013.01); *H01R 13/6592* (2013.01); *H01R 24/44* (2013.01)

(58) Field of Classification Search
CPC ..... H01R 23/7073; H01R 13/648
USPC ..... 439/79, 660, 80, 100, 97
See application file for complete search history.

(56) References Cited

U.S. PATENT DOCUMENTS 6,022,227 A 2/2000 Huang
6,638,104 B2 10/2003 Hashimoto et al.
(Continued)

FOREIGN PATENT DOCUMENTS

WO 2013/063093 A1 5/2013

OTHER PUBLICATIONS

International Search Report and Written Opinion for PCT Application No. PCT/US2012/061662, Mar. 25, 2013.

*Primary Examiner* — Phuongchi T Nguyen
(74) *Attorney, Agent, or Firm* — Altman & Martin; Steven K Martin

(57) ABSTRACT

A controlled-impedance cable termination that minimizes the effects of cable expansion and contraction on impedance matching. The terminator has an anchor block, an expansion/contraction compensator (ECC) attached to the cable, a compliant signal contact for making the electrical connection between the cable center conductor and the electrical device. The ECC has an electrically-conductive ferrule with a bore. The ferrule bore may be formed in the anchor block instead of in a separate ferrule. The cable shield is attached at the bore. A solid dielectric insert fits into the ferrule bore. An electrically-conductive center pin fits into a bore in the dielectric insert and has a bore that accepts the center conductor such that the center conductor can expand and contracting while maintaining electrical contact with the center pin. A plate abuts the anchor block face and holds the compliant contacts through apertures.

32 Claims, 17 Drawing Sheets

(51) Int. Cl.

| | |
|---|---|
| ***H01R 12/71*** | (2011.01) |
| ***H01R 13/6477*** | (2011.01) |
| *H01R 13/6592* | (2011.01) |
| *H01R 12/79* | (2011.01) |
| *H01R 9/03* | (2006.01) |
| *H01R 24/44* | (2011.01) |
| *H01R 13/24* | (2006.01) |

(56) References Cited

U.S. PATENT DOCUMENTS 8,147,254 B2 * 4/2012 Shuey ..... H01R 13/629 439/74
8,147,268 B2 * 4/2012 Shuey ..... H01R 23/27 439/289
8,926,342 B2 * 1/2015 Vinther ..... H01R 9/032 439/79
2002/0050388 A1 5/2002 Simpson
2004/0121631 A1 6/2004 Fan
2005/0032433 A1 2/2005 Lee et al.
2005/0085103 A1 4/2005 Driscoll et al.
2005/0101067 A1 5/2005 Weiss et al.
2009/0023333 A1 1/2009 Soubh et al.
2010/0029130 A1 2/2010 Kretz et al.
2010/0273350 A1 10/2010 Tutt et al.
2011/0034081 A1 2/2011 Feldman et al.
2014/0106589 A1 4/2014 Genta et al.
2014/0111044 A1 4/2014 Baumann et al.

* cited by examiner

CONTROLLED-IMPEDANCE CABLE TERMINATION WITH COMPENSATION FOR CABLE EXPANSION AND CONTRACTION

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to electrical cable terminations, more particularly, to controlled impedance cable terminations which are generally used to transmit high-frequency signals in electronic equipment.

2. Description of the Related Art

The purpose of a cable termination is to provide an interconnect from the cable to the electrical device and to provide a separable electrical interconnection between the cable and its operating environment. The characteristic of separability means that the cables are not interconnected by permanent mechanical means, such as soldering or bonding, but by temporary mechanical means.

Currently, controlled-impedance cables are terminated using a conventional type connector which is also controlled-impedance. Examples include an SMA (SubMiniature version A) connector or cables that are soldered to a printed circuit board (PCB) which is then separably connected to the working environment. The SMA connectors, while being generally the same impedance environment as the cable, have impedance mismatches which cause high-frequency attenuation at the point of interface between the cable and the connector and the connector and its working environment, such as like a PCB. Additionally, these cable terminations often require through holes in PCB's for mounting and, consequently, it can be difficult to design the best possible controlled impedance environment. These types of cable terminations are generally for a single cable and require a substantial amount of PCB area to terminate, thereby decreasing the density capability of connections.

Another form of prior art, disclosed in U.S. Pat. No. 7,544,093, is a system that employs removable cables that are held to the device by means of a spring. The cable has a terminal end which makes the signal conductor protrude from the cable terminal end. The terminal is then pressed to the device by means of a spring and the ground shield of the cable is connected to the device by a conductive rubber ground shield that shorts the terminal ground to the device ground.

Another issue with termination of coaxial cables is the expansion and contraction of the signal conductor and/or the insulator due to temperature excursions and/or cable flexure over time. The cables may need to be very precise and have a consistent electrical length in order to be useful in certain applications. The electrical length refers to the amount of time it would take an electrical signal to propagate the entire length of a cable. It is important that the electrical length be held consistent cable to cable through several flexure cycles or thermal excursions.

Furthermore, with cable terminations that employ compliant contacts, planarity of the cable center conductor and ground shield can be difficult to maintain through flexure or thermal excursions.

BRIEF SUMMARY OF THE INVENTION

The present invention is a controlled-impedance cable termination that minimizes the effects of cable expansion and contraction on impedance matching. The terminator of the present invention employs compliant electrical contacts 12, 14 and an expansion/contraction compensator (ECC) 16 to provide an interface between the controlled-impedance cable and another device.

The terminator has an anchor block for securing the cables, an expansion/contraction compensator (ECC) attached to the end of the cable, a compliant signal contact for making the electrical connection between the cable center conductor and the electrical device, optional compliant ground contacts for making the electrical connection between the cable shield and the ground plane of the device, and an optional plate mounted to the face of the anchor block that holds the contacts. The ECC is installed on the cable and in a cable through hole in the anchor block. The present invention contemplates that the ECC can be permanently installed in the block cable through hole or is designed to be removable.

The ECC has a number of embodiments. Each embodiment includes an electrically-conductive ferrule with a bore. The cable shield is attached to the upper end of the ferrule bore. The cable shield can be attached in any way practical, such as by soldering, crimping, adhesive, etc. The cable shield may be attached to a ground boss that is installed and secured in the ferrule bore.

In most embodiments, the center conductor extends through a section of the ferrule bore with only air, the parameters of which are adjusted to maintain impedance control.

A cylindrical, solid dielectric insert fits into the ferrule bore and operates as an extension of the cable and air dielectric. An electrically-conductive center pin fits into a bore in the dielectric insert and operates as an extension of the center conductor. The parameters of the dielectric insert and center pin are adjusted to maintain impedance control.

The center pin has a bore that accepts the center conductor. A coupling provides the electrical connection between the center conductor and the center pin while accommodating expansion and contraction of the cable center conductor and/or cable dielectric. The present invention contemplates any number of methods of providing the coupling. In most methods, the center conductor fits snuggly within the bore such that the center conductor can expand and contract, while maintaining electrical contact with the center pin. In one method, the bore is filled with a conductive epoxy or elastomer. The elastomer electrically connects the center conductor to the center pin and stretches when the center conductor expands and contracts.

In one configuration, the anchor block is made from an insulating material and the ground contacts alone couple the cable shield via the ECC ferrule to the ground plane of the device. Alternatively, the anchor block is conductive to provide a common ground for the cable shields.

The present invention contemplates that the ferrule bore may not be in an independent component, but formed directly in the conductive anchor block.

The plate holds the compliant contacts and its structure depends on the type of contact. Regardless of the type of contact, the plate has several common features. The plate has an anchor block face surface that abuts the anchor block face and a device surface that generally abuts the device. The plate has at least one through aperture for the contacts. Each aperture has an anchor block face opening and a device face opening. The apertures for the signal contacts are aligned with the corresponding center pin face in the anchor block.

The plate can be either insulating or conductive. A conductive plate electrically couples the ground contacts, thereby providing more precise impedance matching to the signal contact. The signal contact is insulated from the conductive plate by an insulating centering plug.

Skewed coil and conductive rubber contacts are two forms of compliant contacts contemplated by the present invention.

The present invention also contemplates that the signal contact is an element of the ECC, for example, a pogo pin extending from the center pin. The center pin has a bore with a spring and a pogo pin extending from the bore.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
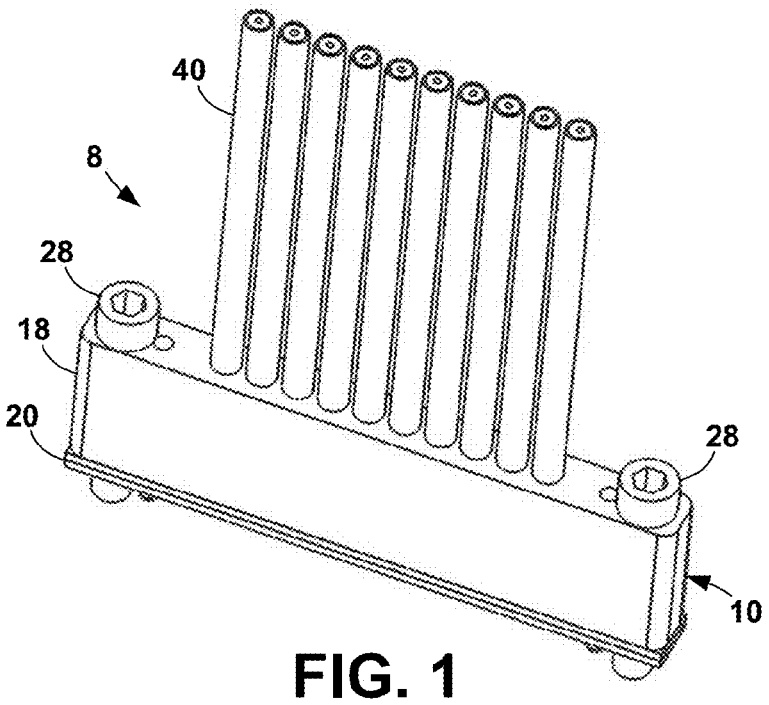
FIG. 1 is an isometric view of the cable termination assembly of the present invention for use with coaxial cables.

The present application hereby incorporates by reference in its entirety U.S. Provisional Patent Application No. 61/980,040, on which this application is based.

The present invention is a controlled-impedance cable termination that minimizes the effects of cable expansion and contraction on impedance matching. With the present invention, impedance mismatches are minimized, allowing the cable to be more useful in high-frequency signal ranges. The present invention can be used with any cable structure where the impedance between the inner conductor(s) and the ground shield is controlled.

The present invention is for use with controlled-impedance cables having one or more central conductors. A coaxial cable 40 has a center conductor 42 surrounded by a dielectric 44 with a ground reference shield 46 outside the dielectric 44. Optionally, a sheath 48 covers the shield 46. A twin-axial cable 40 has two center conductors 42 surrounded by a dielectric 44 with a ground reference shield 46 outside the dielectric 44 and a sheath 48 covering the shield 46. Cables with more than two center conductors are available. Although not specifically described, the present invention can be adapted to accommodate cables having two or more center conductors.

Figure 2:
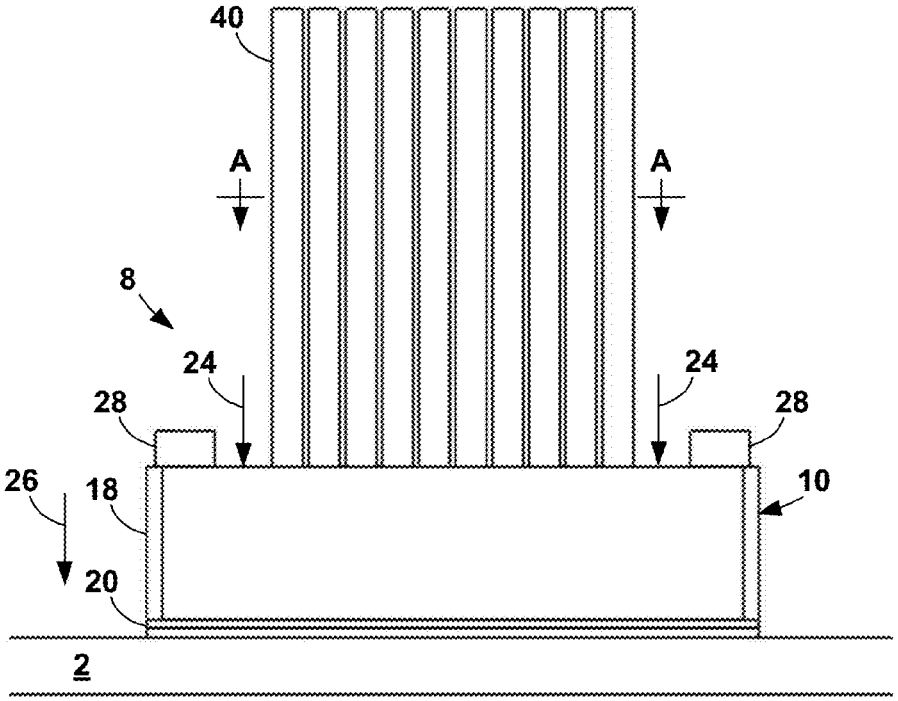
FIG. 2 is a front view of the cable termination assembly of FIG. 1 connected to a device.
Figure 3:
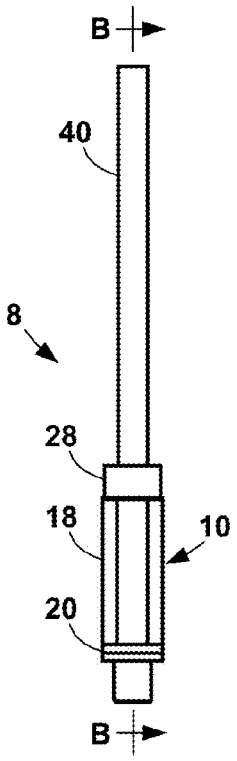
FIG. 3 is a side view of the cable termination assembly of FIG. 1.
Figure 4:
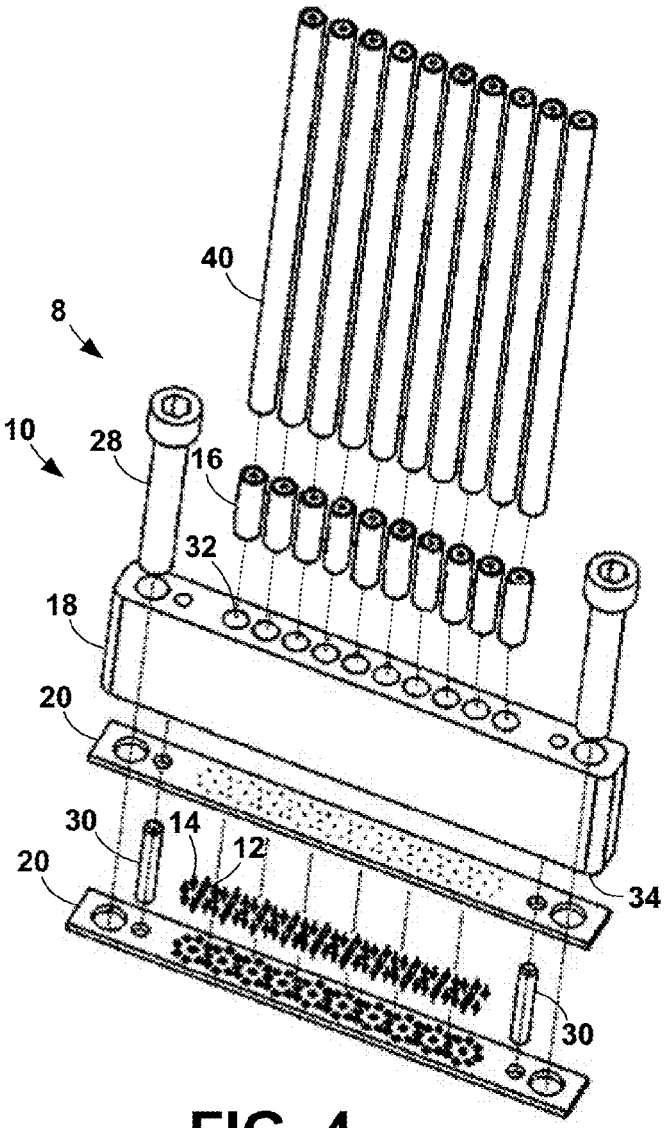
FIG. 4 is an exploded view of the cable termination assembly of FIG. 1.
Figure 5:
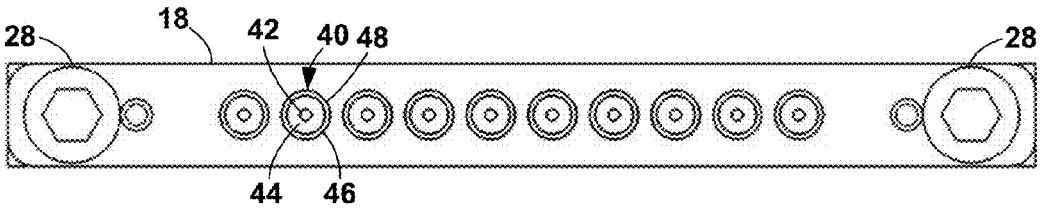
FIG. 5 is a top cross-sectional view of the cable termination assembly of FIG. 2 taken along the line A-A.
Figure 6:
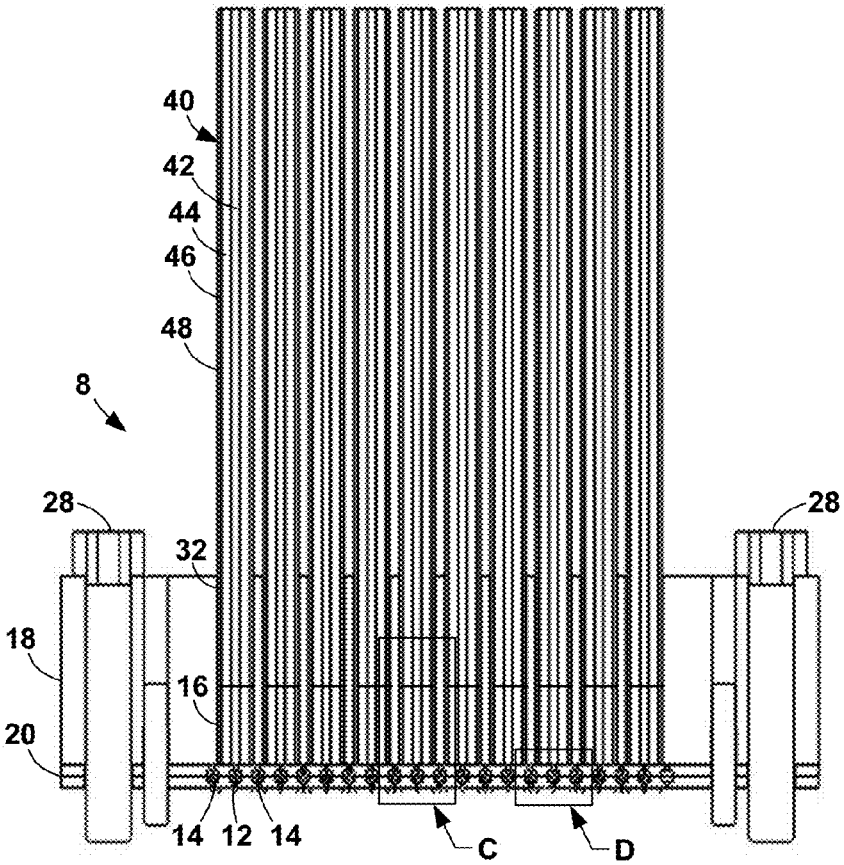
FIG. 6 is a front cross-sectional view of the cable termination assembly of FIG. 3 taken along the line B-B.

As shown in FIGS. 1-7, the present invention includes a cable terminator 10 that employs compliant electrical contacts 12, 14 and an expansion/contraction compensator (ECC) 16 to provide an interface between the controlled-impedance cable (hereinafter, simply "cable") 40 and another device 2, typically an integrated circuit (IC) or a printed circuit board (PCB). The terminator 10 is installed on the cable 40 as described below. The combination of terminator 10 and cable(s) is referred to as the cable termination assembly 8. As shown in FIG. 2, the assembly 8 is removably attached to the electrical device 2 by a compression force 24 in a direction of compression 26. Typically, jack screws 28 provide the compression force 24. Jack screws 28 may not compress the assembly 8 and the electrical device 2 together linearly. Compliant contacts 12, 14 facilitate an adequate connection between the cables 30 and the electrical device 2, compensating for noncoplanarities in the conduction points 4 of the electrical device 2.

As shown in FIGS. 1-7, the terminator 10 has an anchor block 18 for securing the cables 40, an expansion/contraction compensator (ECC) 16 attached to the end of the cable 40, one or more compliant signal contacts 12 for making the electrical connection between the cable center conductor(s) 42 and the electrical device 2, optional compliant ground contacts 14 for making the electrical connection between the cable shield 46 and the ground plane of the device 2, and an optional plate 20 mounted to the face 34 of the anchor block 18 that holds the contacts 12, 14. The ECC 16 compensates for any expansion and contraction of the center conductor 42 and/or dielectric 44 due to temperature, flexure, or other external factors.

Figure 8:
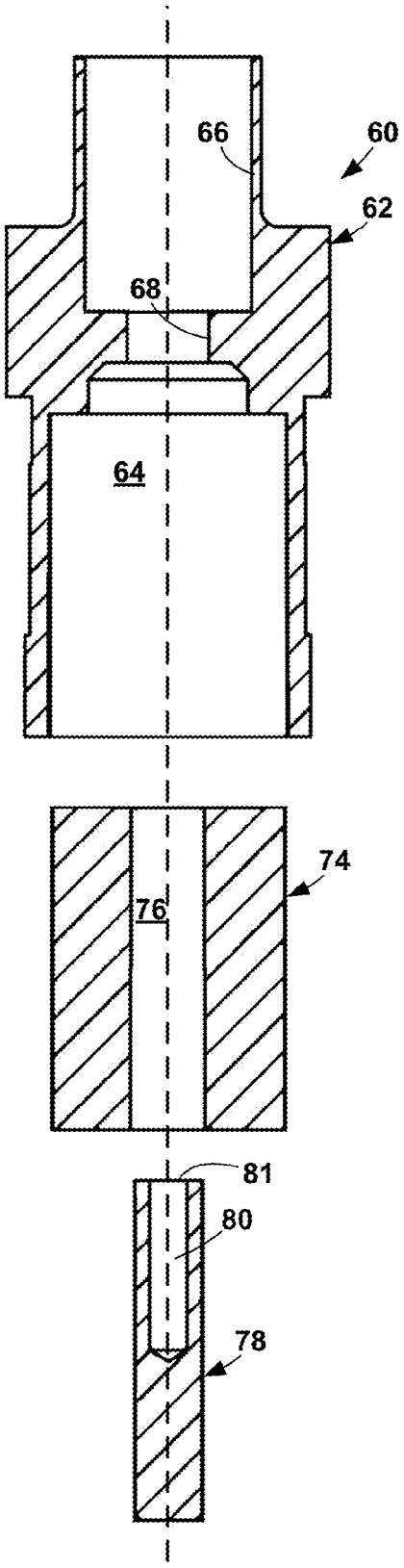
FIG. 8 is an exploded, cross-sectional, side view of the press-in, air dielectric embodiment of the expansion/contraction compensator.
Figure 9:
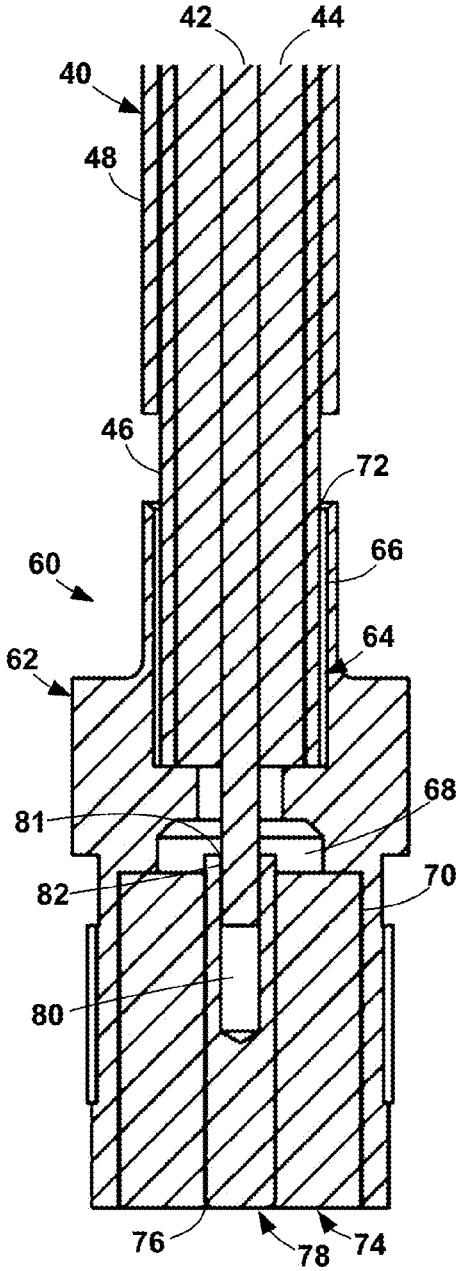
FIG. 9 is a cross-sectional, side view of the embodiment of FIG. 8 assembled with a cable.

The first embodiment 60 of the ECC 16 is shown in FIGS. 8 and 9. It is a press-fit embodiment with a partial air dielectric. This embodiment 60 has an electrically-conductive, cylindrical ferrule 62 with an axial bore 64. The bore 64 has several sections. The cable section 66 has a diameter that is adapted to accept a cable 40 with the sheath 48 stripped back, as in FIG. 9. The ferrule 62 is attached to the cable shield 46 by soldering, as at 72, crimping, or other mechanical means that electrically couples the ferrule 62 to the shield 46.

The air section 68 is empty but for air and operates as an extension of the cable dielectric 44. As shown in FIG. 9, the center conductor 42 extends through the air section 68. The parameters of the air section 68, primarily the length and diameter, are adjusted to maintain impedance control in a manner known in the art.

The dielectric section 70 is sized to accept a press-fit, axial-aligned, cylindrical dielectric insert 74 composed of a solid dielectric material. The dielectric insert 74 operates as an extension of the cable dielectric 44 and air dielectric in the air section 68.

The dielectric insert 74 has an axial bore 76 to receive a press-fit, electrically-conductive center pin 78. The center pin 78 operates as an extension of the cable center conductor 42. The parameters of the dielectric insert 74 and center pin 78, primarily the lengths and several diameters, are adjusted to maintain impedance control in a manner known in the art.

The center pin 78 has an axial bore 80 with an opening 81 that accepts the cable center conductor 42. A coupling 82 provides the electrical connection between the center conductor 42 and the center pin 78 while accommodating expansion and contraction of the cable center conductor 42 and/or cable dielectric 44. The present invention contemplates any number of methods of providing the coupling 82. Examples of particular methods are described below.

In one method, the diameter of the bore 80 is such that the center conductor 42 fits snuggly within the bore 80. When the center conductor 42 expands and/or contracts axially, it slides (reciprocates) within the bore 80. Therefore, the fit within the bore 80 cannot be so snug that the center conductor 42 cannot slide when it expands and contracts.

Figure 10:
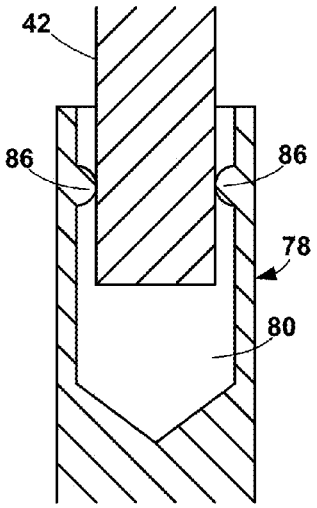
FIG. 10 is a detailed, cross-sectional, side view of a detent central conductor/central pin coupling with the central conductor.
Figure 11:
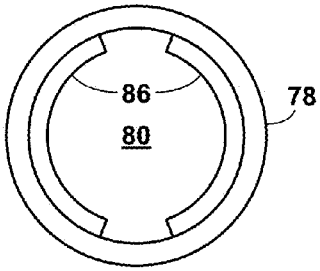
FIG. 11 is a detailed, top view of one configuration of the detent central conductor/central pin coupling of FIG. 10.

In another method, shown in FIGS. 10 and 11, the diameter of the bore 80 is larger than that of the center conductor 42 and an annular protrusion or detent 86 extends from the inside of the bore 80. The center conductor 42 fits snuggly within the detent 86. When the center conductor 42 expands and/or contracts axially, it slides (reciprocates) within the bore 80. Therefore, the fit within the detent 86 cannot be so snug that the center conductor 42 cannot slide when it expands and contracts. The detent 86 can extend continuously around the bore 80 or can be sectioned, as in FIG. 11.

Figure 12:
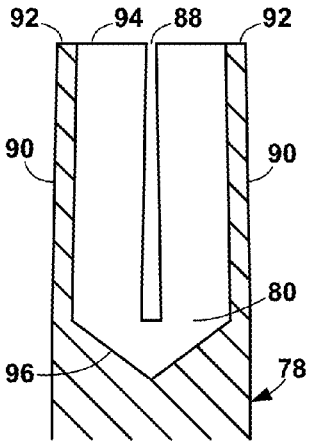
FIG. 12 is a detailed, cross-sectional, side view of a slot pinch central conductor/central pin coupling.
Figure 13:
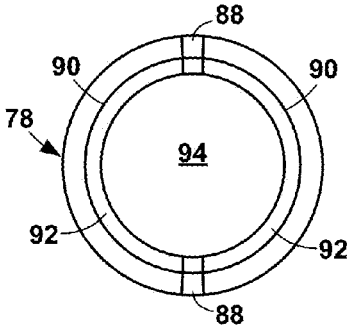
FIG. 13 is a detailed, top view of the slot pinch central conductor/central pin coupling of FIG. 12.

In another method, shown in FIGS. 12 and 13, the bore 80 is sectioned by two or more radial slots 88. Two slots 88 are shown in FIGS. 12 and 13. The upper end 92 of the sections 90 formed by the slots 88 are pinched together to narrow the opening 94 for the center conductor 42 as compared to the bottom 96 of the bore 80. The center conductor 42 fits snuggly within the opening 94. When the center conductor 42 expands and/or contracts axially, it slides (reciprocates) within the bore 80. Therefore, the fit within the opening 94 cannot be so snug that the center conductor 42 cannot slide when it expands and contracts. The slot 88 provides the opening 94 with more resilience while maintaining a secure connection. The resilience of the opening 94 also provides a better connection while accommodating variances in the diameter of the cable center conductor 42.

Figure 14:
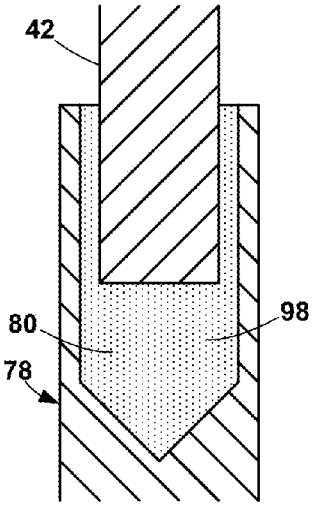
FIG. 14 is a detailed, cross-sectional, side view of a conductive elastomer central conductor/central pin coupling with the central conductor.

In another method, shown in FIG. 14, the bore 80 is filled with a conductive epoxy or elastomer 96. The elastomer 96 electrically connects the center conductor 42 to the center pin 78. When the center conductor 42 expands and/or contracts axially, it slides (reciprocates) within the bore 80. The resilience of the epoxy or elastomer 96 must be such that it can stretch and compress enough to allow the center conductor 42 to expand and contract.

In another method, the center conductor 42 is inserted into the bore 80 and soldered to the center pin 78. This method can accommodate expansion and contraction of the cable dielectric 44 while forcing any expansion and contraction of the center conductor 42 to occur away from the ECC 16 and toward the other end of the cable 40.

The present invention contemplates the use of any method that can provide an acceptable electrical connection between the center conductor 42 and the center pin 78 that accommodates expansion and contraction of the center conductor 42 and/or the cable dielectric 44.

Figure 15:
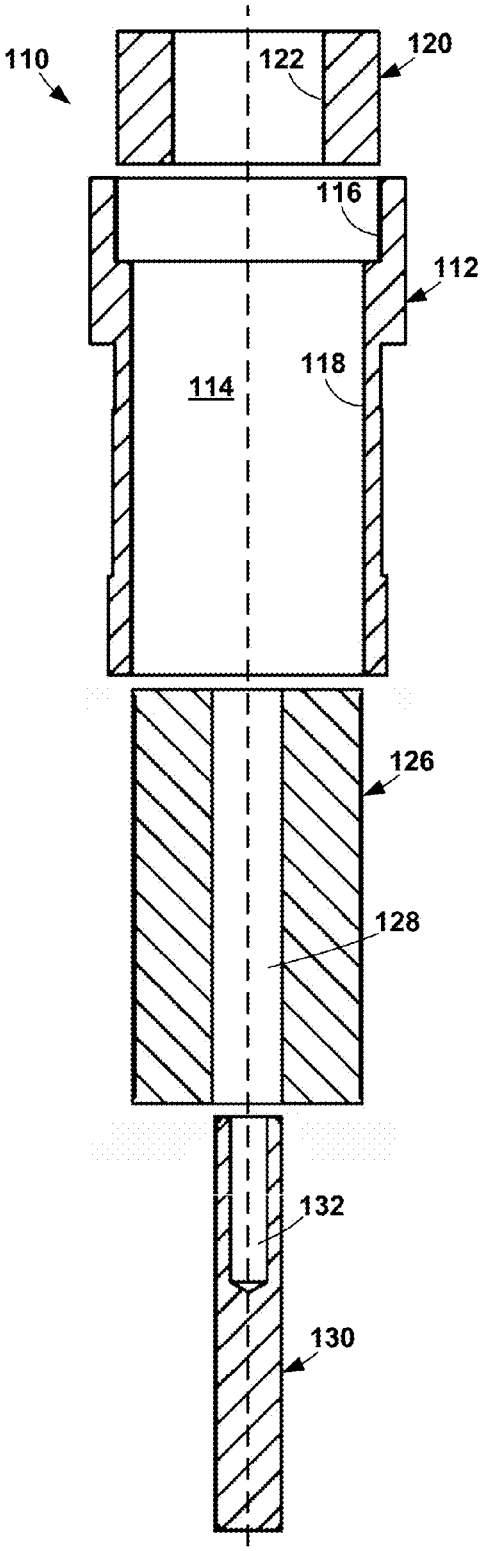
FIG. 15 is an exploded, cross-sectional view of the press-in solid embodiment of the expansion/contraction compensator.
Figure 16:
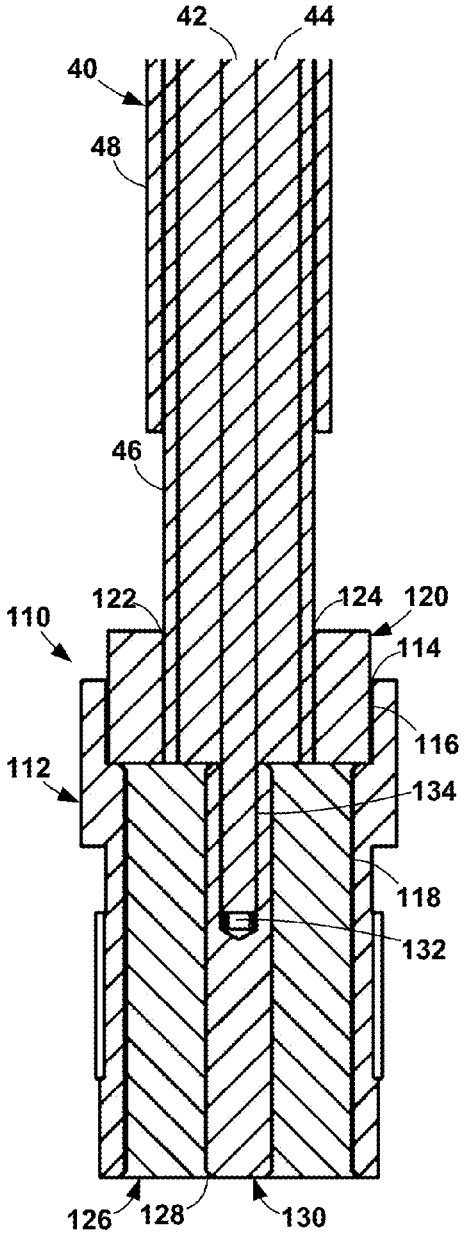
FIG. 16 is a cross-sectional view of the embodiment of FIG. 15 assembled with a cable.
Figure 17:
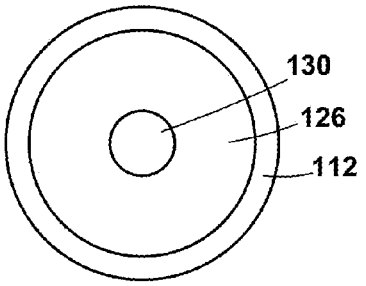
FIG. 17 is a bottom view of the embodiment of FIG. 15.

The second embodiment 110 of the ECC 16 is shown in FIGS. 15-17. It is a press-fit embodiment with a completely solid dielectric. This embodiment 110 has an electrically-conductive, cylindrical ferrule 112 with an axial bore 114. The bore 114 has several sections. The ground boss section 116 accepts a ground boss 120. The ground boss 120 is a cylinder that has a bore 122 that accepts a cable 40 that has had the sheath 48 stripped back, as in FIG. 16. The shield 46 is typically soldered to the ground boss 120, as at 124, but can be attached in any way practical. The ground boss 120 can be secured into the ground boss section 116 in whatever manner is desired. For example, the ground boss 120 can be press-fit into the ground boss section 116, the ground boss 120 can be threaded and turned into the ground boss section 116, or the ground boss 120 can be secured in the ground boss section 116 by a locking nut.

The dielectric section 118 is sized to accept a press-fit, axial-aligned, cylindrical, solid dielectric insert 126. The dielectric insert 126 operates as an extension of the cable dielectric 44.

The dielectric insert 126 has an axial bore 128 for a press-fit, electrically-conductive center pin 130. The center pin 130 operates as an extension of the cable center conductor 42. The parameters of the dielectric insert 126 and center pin 130, primarily the lengths and diameters, are adjusted to maintain impedance control in a manner known in the art.

The center pin 130 has an axial bore 132 that accepts the cable center conductor 42. A coupling 134 provides the electrical connection between the center conductor 42 and the center pin 130 while accommodating expansion and contraction of the cable center conductor 42 and/or cable dielectric 44. Methods of providing the coupling 134 are described above with reference to the partial air dielectric, press-fit embodiment 60 of the ECC 16.

Figure 18:
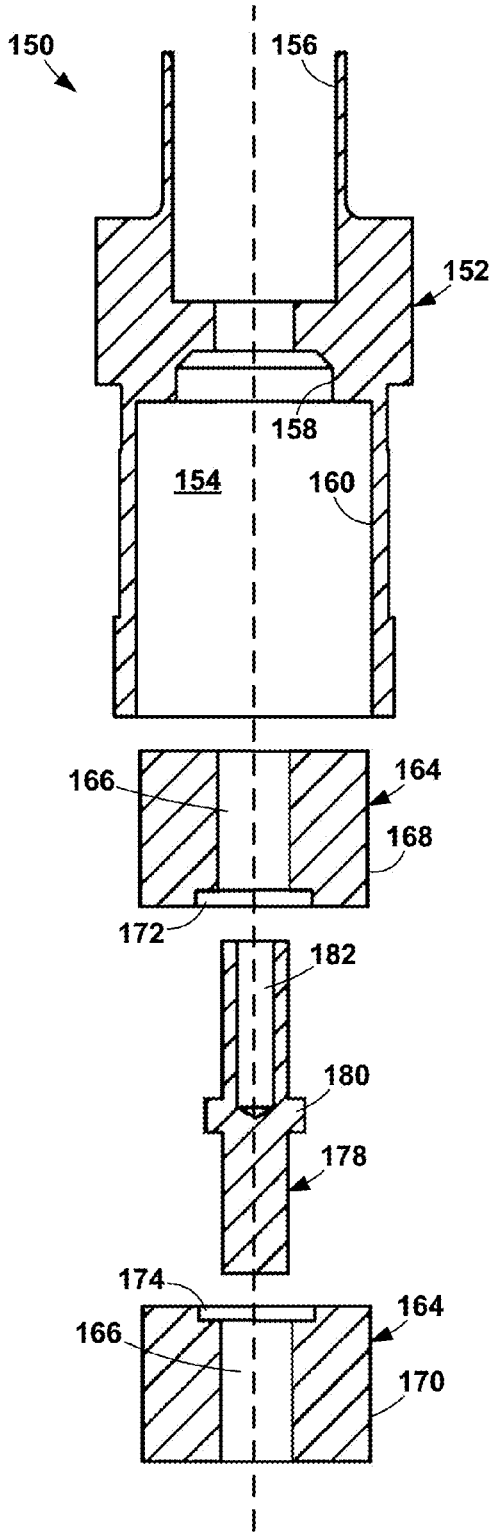
FIG. 18 is an exploded, cross-sectional view of the flanged embodiment of the expansion/contraction compensator.
Figure 19:
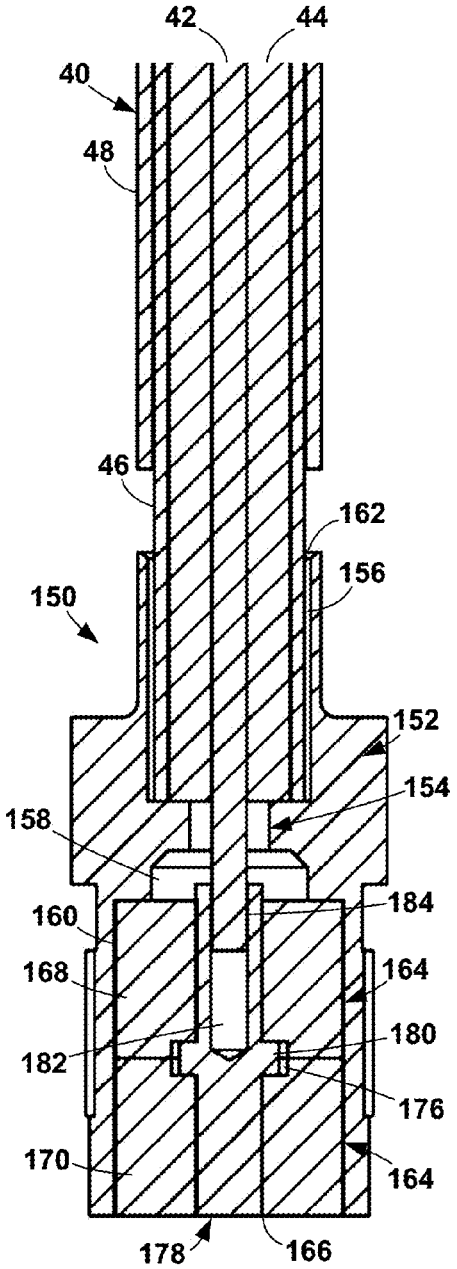
FIG. 19 is a cross-sectional view of the embodiment of FIG. 18 assembled with a cable.

The third embodiment 150 of the ECC 16 is shown in FIGS. 18 and 19. It is a flanged embodiment with a partial air dielectric. This embodiment 150 has an electrically-conductive, cylindrical ferrule 152 with an axial bore 154. The bore 154 has several sections. The cable section 156 has a diameter that is adapted to accept a cable 40 with the sheath 48 stripped back, as in FIG. 19. The shield 46 is soldered to the ferrule 152, as at 162.

The air section 158 is empty but for air and operates as an extension of the cable dielectric 44. As shown in FIG. 19, the center conductor 42 extends through the air section 158. The parameters of the air section 158, primarily the length and diameter, are adjusted to maintain impedance control in a manner known in the art.

The dielectric section 160 is sized to accept a press-fit, axial-aligned, cylindrical, solid dielectric insert 164. The dielectric insert 164 operates as an extension of the cable dielectric 44 and air dielectric in the air section 158. The dielectric insert 164 is in two sections, an inner section 168 and an outer section 170, as described below.

The dielectric insert 164 has an axial bore 166 for a flanged, electrically-conductive center pin 178. The center pin 178 operates as an extension of the cable center conductor 42. The center pin 178 has an annular flange 180 for capturing the center pin 178 in the dielectric insert 164.

As shown in FIG. 19, the dielectric insert inner section 168 is inserted into the axial bore 154. The center pin 178 is inserted into the bore 166 of the inner section 168. The flange 180 fits into a notch 172 (a larger diameter section of the bore 182) in the inner section 168. The dielectric insert outer section 170 is inserted into the axial bore 154 and an annular notch 174 captures the flange 180. Between the flange 180 and the wall of the notches 172, 174 is an air gap 176.

The parameters of the dielectric insert 164 and center pin 178, primarily the lengths, several diameters, and the size of the notch air gap 176, are adjusted to maintain impedance control in a manner known in the art.

The center pin 178 has an axial bore 182 that accepts the cable center conductor 42. A coupling 184 provides the electrical connection between the center conductor 42 and the center pin 178 while accommodating expansion and contraction of the cable center conductor 42 and/or cable dielectric 44. Methods of providing the coupling 184 are described above with reference to the partial air dielectric, press-fit embodiment 60 of the ECC 16.

Figure 20:
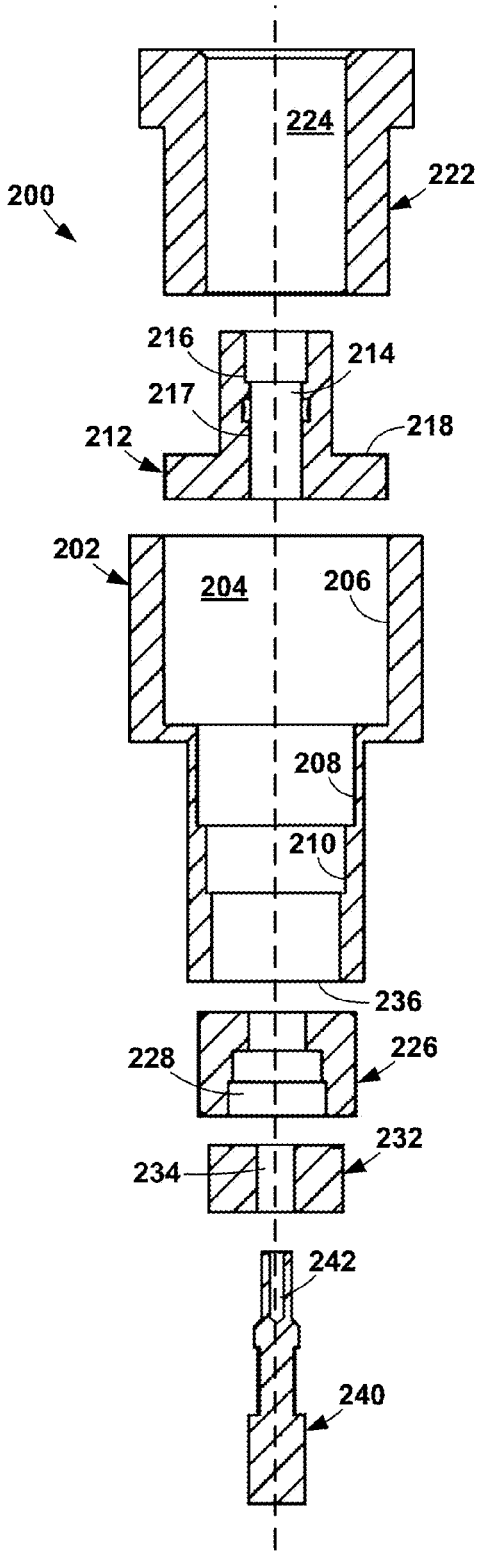
FIG. 20 is an exploded, cross-sectional view of the separable air dielectric embodiment of the expansion/contraction compensator.
Figure 21:
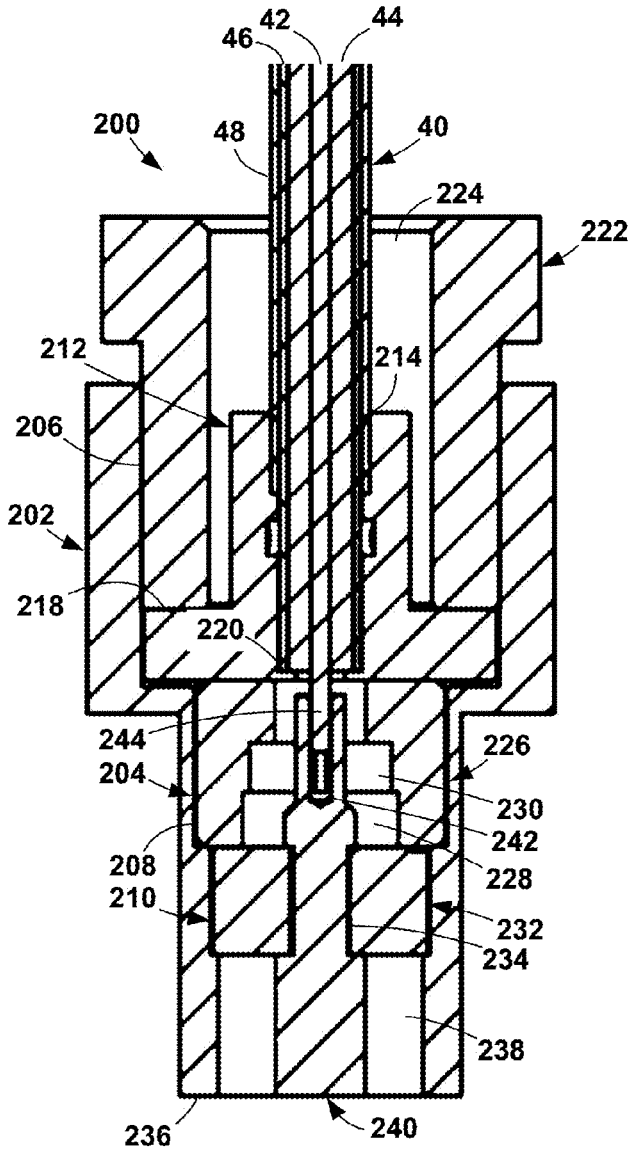
FIG. 21 is a cross-sectional view of the embodiment of FIG. 20 assembled with a cable.

The fourth embodiment 200 of the ECC 16 is shown in FIGS. 20 and 21. It is a press-fit embodiment with a partial air dielectric. This embodiment 200 has an electrically-conductive, cylindrical ferrule 202 with an axial bore 204. The bore 204 has several sections. The cable section 206 has a diameter that is adapted to accept a ground boss 212. The cable 40 with the sheath 48 stripped back is inserted into an axial bore 214 in the ground boss 212, as in FIG. 21. The ground boss bore 214 may have a consistent diameter or the ground boss bore 214 may have a counter bore with a larger upper diameter, as at 216. The diametric change would act as an assembly stop for the assembler to know more precisely when the cable is tightly seated to the bottom of the ground boss 212. The lower portion 217 of the ground boss bore 214 is sized to have the cable ground shield 46 fixed and electrically coupled to the ground boss 212 by soldering or crimping or some other mechanical means.

The ground boss 212 is inserted into the ferrule bore 204 and is secured by a locking nut 222, press fit, soldered, held in-place with an ID circlip, or other appropriate mechanism. The locking nut 222 has external threads that turn into internal threads in the cable section 206 of the ferrule bore 204. The ground boss 212 has an annular shoulder 218 that the locking nut 222 abuts to hold the ground boss 212 in the ferrule 212. The cable 40 extends through a bore 224 in the locking nut 222.

The impedance control section 208 holds an impedance control boss 226. The impedance control boss 226 is a ring with an axial bore 228. The impedance control boss 226 is installed into the impedance control section 208 such that it makes electrical contact with the ground boss 212 and the ferrule 202, thereby operating to electrically connect the ground boss 212 to the ferrule 202.

As shown in FIG. 21, the center conductor 42 extends through the impedance control boss bore 228.

The dielectric section 210 accepts an electrically-conductive center pin 240. The center pin 240 is secured in the dielectric section 210 by a solid dielectric centering ring 232 that is press-fit into the dielectric section 210. Alternatively, the dielectric centering ring 232 is made with a feature such as a slice parallel to the axis which allows it to expanded over capture features in the center pin 240. The center pin 240 fits in and is held by a bore 234 in the dielectric centering ring 232. The dielectric centering ring 232 has a thickness that is as small as practical in order to minimize its effect on the system. The purpose of the dielectric centering ring 232 is to securely maintain the position of the center pin 240. To that end, the thickness of the dielectric centering ring 232 must be large enough to prevent rocking of the center pin 240 in the centering ring bore 234.

Defined by the ground boss 212, the impedance control boss 226, the dielectric centering ring 232, and the center pin 240 is an air space 230. The air space 230 operates as an extension of the cable dielectric 44. The parameters of the air space 230, primarily the length and diameter, are adjusted to maintain impedance control in a manner known in the art.

Between the dielectric centering ring 232 and the lower end 236 of the ferrule 212 is a cylindrical air space 238 that operates as an extension of the cable dielectric 44. The parameters of the air space 238, primarily the length and diameter, are adjusted to maintain impedance control in a manner known in the art.

The center pin 240 has an axial bore 242 that accepts the cable center conductor 42. A coupling 244 provides the electrical connection between the center conductor 42 and the center pin 240 while accommodating expansion and contraction of the cable center conductor 42 and/or cable dielectric 44. Methods of providing the coupling 184 are described above with reference to the partial air dielectric, press-fit embodiment 60 of the ECC 16.

The ECC 16 is installed on the cable 40 and in a cable through hole 32 in the anchor block 18. The present invention contemplates that the ECC can be permanently installed in the block cable through hole 32 or is designed to be removable. An opening 36 in the face 34 of the anchor block 18 provides access to the ECC 16 for the compliant contacts 12, 14.

In one configuration, the anchor block 18 is made from an insulating material and the ground contacts 14 alone couple the cable shield 46 via the ECC ferrule 38 to the ground plane of the device 2. In such cases, the ECC ferrule 38 will typically be thicker for a better connection with the ground contacts 14. In addition, a single ground contact 14 that may be shared between two cables 40 will typically become two ground contacts 14, one for each cable 40.

Figure 7:
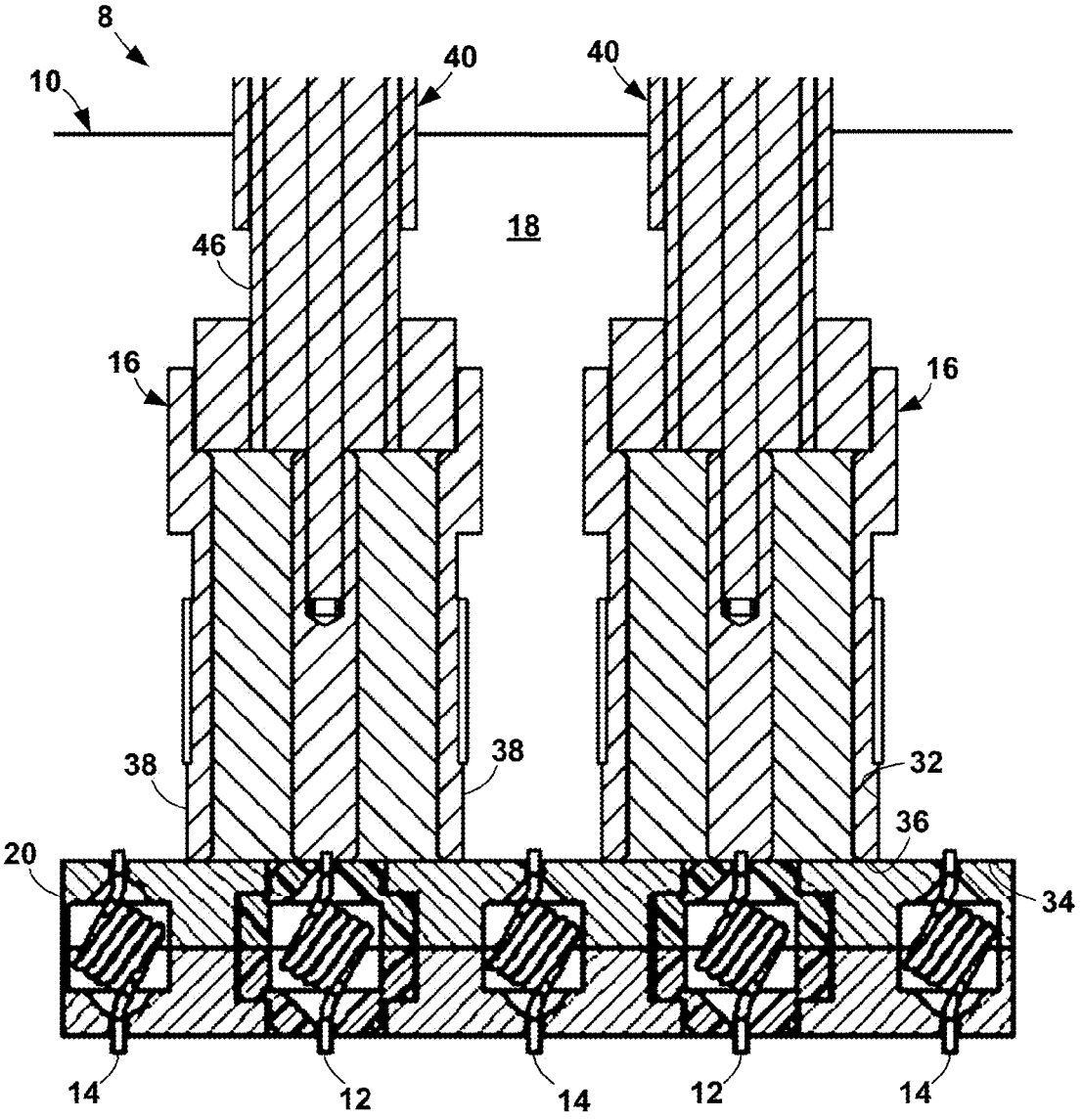
FIG. 7 is a detailed view of FIG. 6 taken at C showing the coax cable termination.

Alternatively, as shown in FIG. 7, the anchor block 18 is conductive to provide a common ground for the shields 46 of more than one cable 40. The optional ground contacts 14 make the electrical connection between the anchor block 18 and the ground plane of the device 2.

Figure 22:
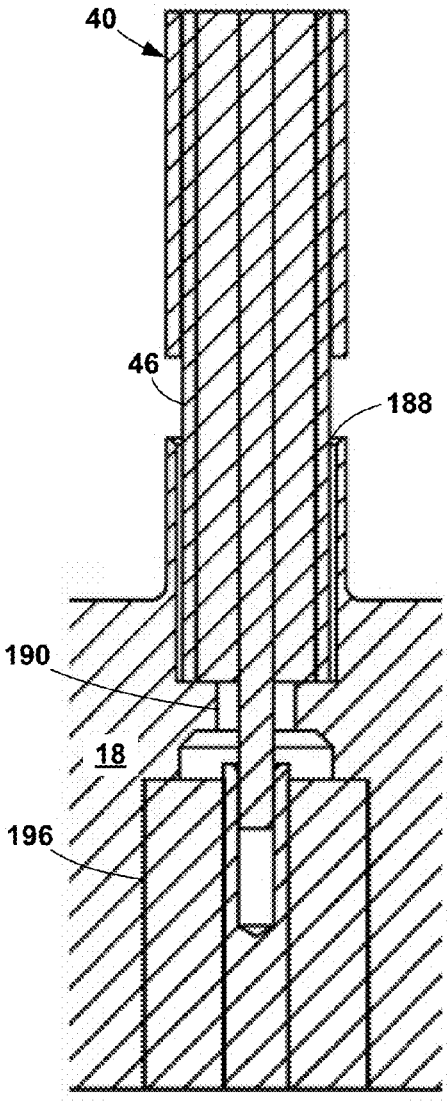
FIG. 22 is a cross-sectional view of the embodiment of FIG. 9 showing the ferrule integrated with the anchor block.

The present invention contemplates that the ferrule may not be an independent component, but is integrated with the anchor block 18. In other words, the ferrule bore 190 is formed directly in the anchor block 18. This structure only works when the anchor block 18 is electrically conductive. FIG. 22 shows the partial air dielectric embodiment 60 of FIGS. 8 and 9 with the ferrule as part of the anchor block 18. The cable shield 46 is attached directly to the anchor block 18, as at 188.

Figure 23:
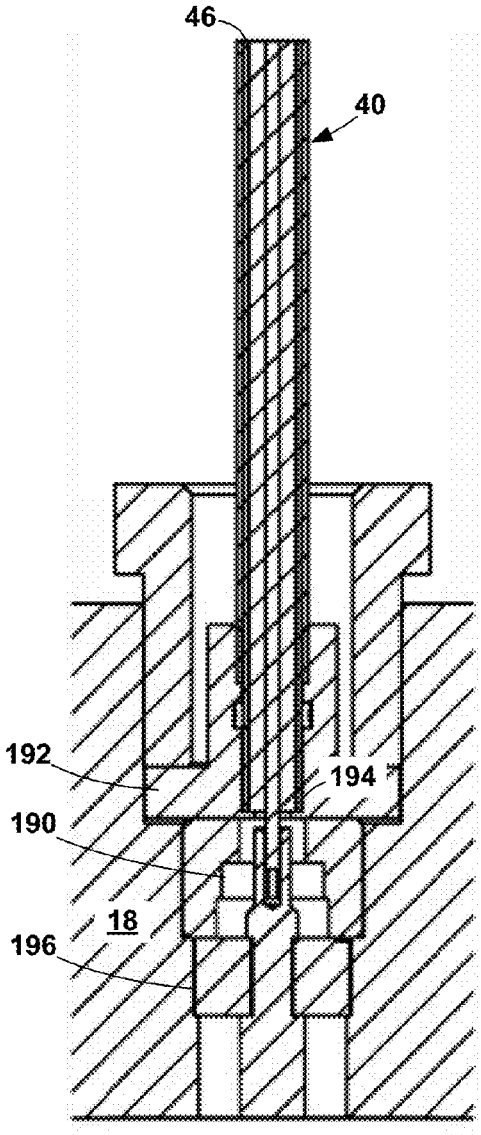
FIG. 23 is a cross-sectional view of the embodiment of FIG. 21 showing the ferrule integrated with the anchor block.

FIG. 23 shows the air dielectric embodiment 200 of FIGS. 20 and 21 with the ferrule as part of the anchor block 18. The shield 46 is attached to the ground boss 192, as at 194. The ground boss 192 is inserted into the ferrule (anchor block) bore 190 and secured, as described above with reference to the embodiment of FIGS. 20 and 21.

The term, ferrule bore, is used to describe the bore 190 into which the dielectric 196 is installed, whether it is in the anchor block 18 or in a ferrule 36 installed in the anchor block 18.

Figure 24:
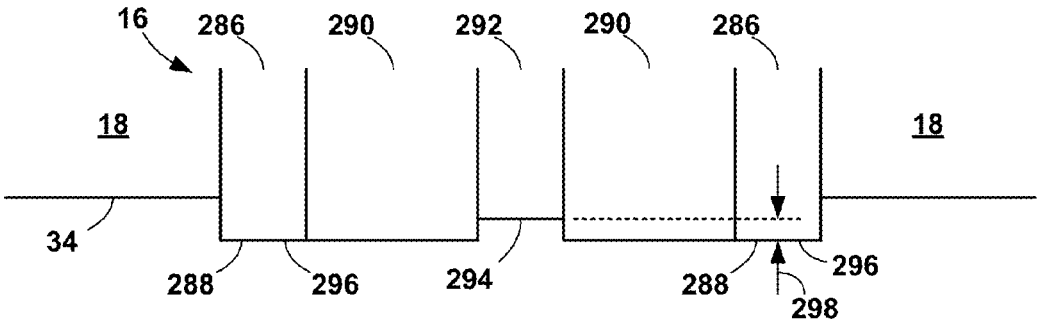
FIG. 24 is a detailed, exaggerated, cross-sectional view of an ECC installed in a non-conductive anchor block with a protruding ferrule and a recessed center pin.
Figure 25:
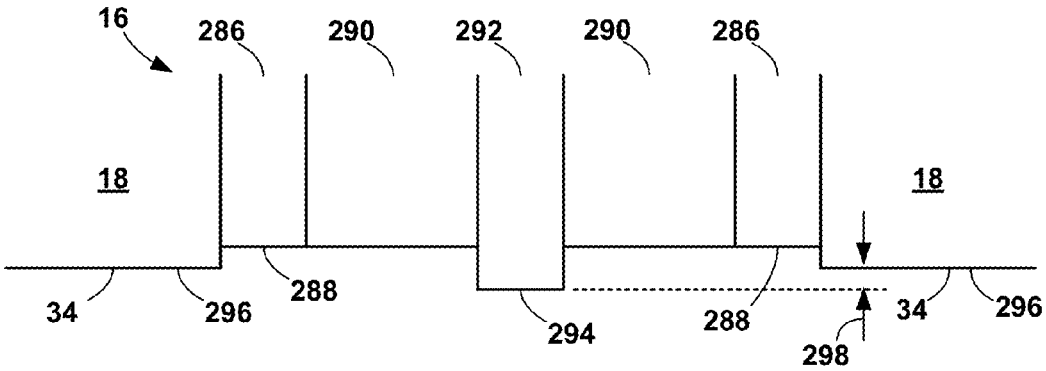
FIG. 25 is a detailed, exaggerated, cross-sectional view of an ECC installed in a conductive anchor block with a recessed ferrule and protruding center pin.

Referring to FIGS. 24 and 25, typically, the ECC 16 will be relatively flush with the anchor block face 34. However, in some designs, particularly with removable attachments and where the ferrule is a separate component from the anchor block 18, the ECC 16 may not be exactly flush with the anchor block face 34, that is, it may be slightly recessed into or protruding from the anchor block face 34. That recession or protrusion can be as much as 0.050 inch (50 mils). The present invention considers that such variability to be flush.

Referring to FIGS. 24 and 25, it is expected that the face 294 of the center pin 292 is generally planar with the ground plane 296. If the anchor block 18 is non-conductive, the ground plane 296 is the face 288 of the ferrule 286. If the anchor block 18 is conductive, the ground plane 296 can either be the ferrule face 288 or the anchor block face 34, and the location of the ground contact 14 determines which is the ground plane 296. If the ground contact 14 is in physical contact with the ferrule face 288, it is the ground plane 296. If the ground contact 14 is in physical contact with the anchor block face 34, it is the ground plane 296. The ferrule face 288 is considered to be part of the anchor block face 34 when anchor block 18 is conductive. This means that the ground contact is considered to be in physical contact with the anchor block face 34 if it is in physical contact with either the anchor block face 34 or the ferrule face 288.

As indicated above, it is expected that the center pin face 294 is planar with the ground plane 296. Due to tolerances in the materials and manufacturing process, the center pin 294 will most likely not be exactly planar with the ground place 296. The present invention contemplates that the largest displacement 298 between the center pin face 294 and the ground plane 296 is ±0.050 inches (50 mils). The present inventions considers up to this amount of displacement to be planar.

The present invention contemplates that the various components are composed of materials well-known in the art. For example, the ferrule and center pin are composed of standard conductive materials. The solid dielectric components can be composed of any appropriate dielectric material. Preferably, the dielectric material has a dielectric constant as low as practical. Example materials include Polytetrafluoroethylene (PTFE), aerated PTFE (PTFE mixed with air during extrusion), and polyetherimide (PEI). The dielectric constant of the components can be reduced by boring holes into the component so that a significant portion of the component is air, while retaining the component's integrity.

Figure 28:
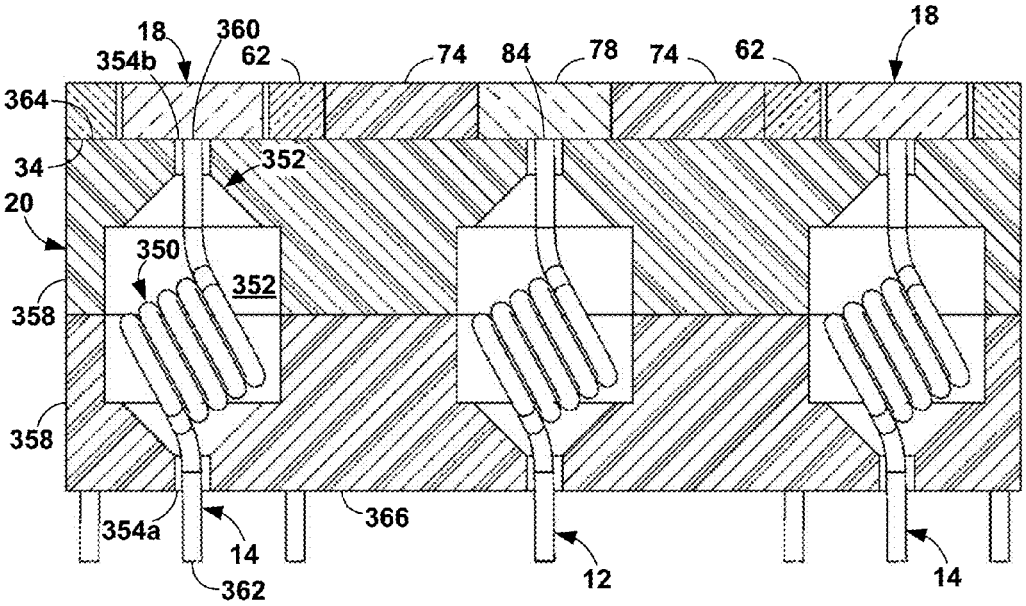
FIG. 28 is a detailed view of FIG. 6 taken at D showing the compliant contacts as skewed coil contacts.
Figure 29:
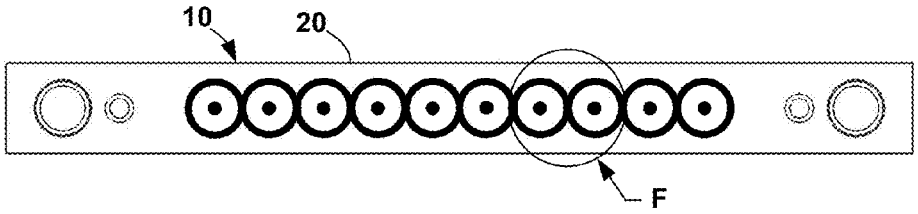
FIG. 29 is bottom view of the cable termination assembly of FIG. 1 with an insulating plate.
Figure 30:
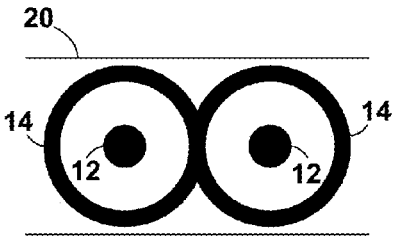
FIG. 30 is a detail view of the bottom of the coax cable termination assembly of FIG. 29 taken at F.
Figure 31:
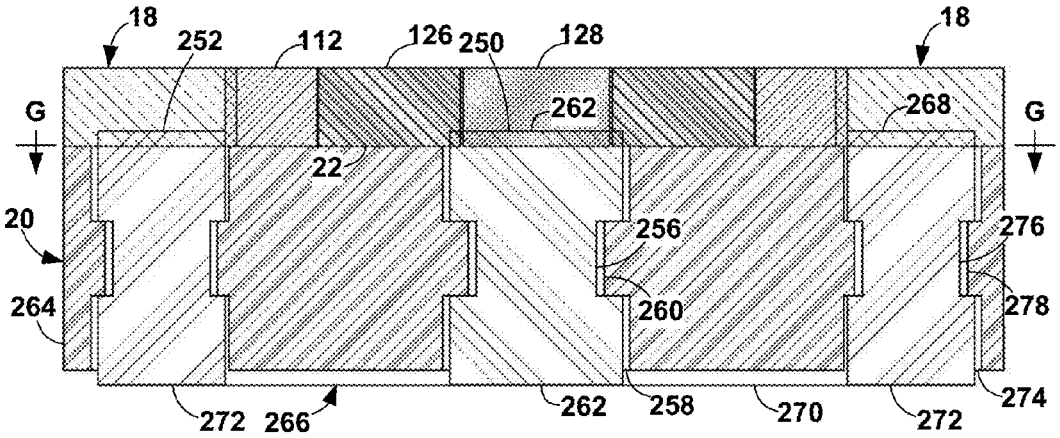
FIG. 31 is a detailed view of FIG. 6 taken at D showing the compliant contacts as conductive rubber contacts with an insulating plate.
Figure 32:
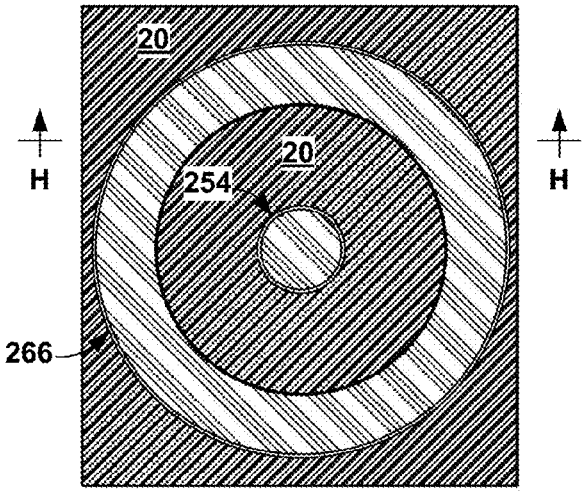
FIG. 32 is a cross-sectional view of FIG. 31 taken at G-G.
Figure 33:
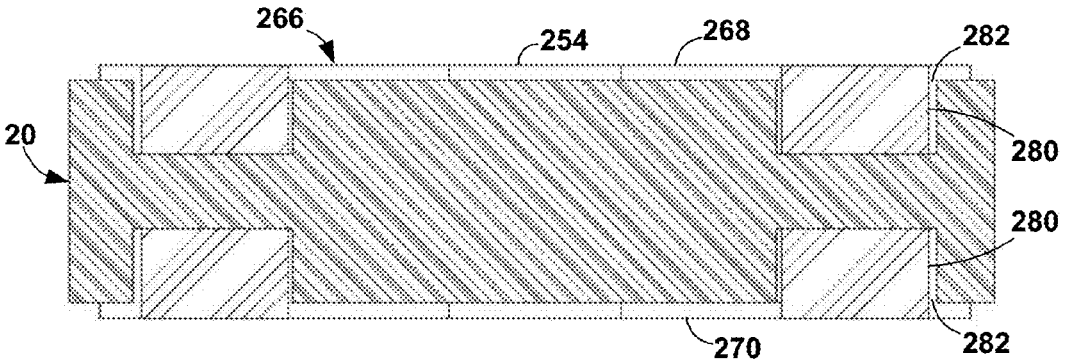
FIG. 33 is a cross-sectional view of FIG. 32 taken at H-H.

As indicated above, the plate 20 holds the compliant contacts 12, 14. The structure of the plate 20 depends on the type of contact. Regardless of the type of contact, the plate 20 has several common features. These features are shown in FIG. 28 with reference to the skewed coil contact, but apply to all types of contacts. The plate 20 has an anchor block face surface 364 that abuts the anchor block face 34 when the terminator 10 is assembled. The plate 20 has a device surface 366 that generally abuts the device 2 when the terminator 10 is connected to the device 2. The plate 20 has at least one through aperture 352 for the contacts 12, 14. The apertures 352 are either signal apertures or ground apertures, depending on the type of signal that is carried in the contact in that aperture 352. Each aperture 352 has an anchor block face opening **354*b* and a device face opening 354*a*. The signal apertures for the signal contacts 12 are aligned with the corresponding center pin face 84 in the anchor block 18. Prior to assembling the plate 20 to the anchor block 20, the anchor block contact point 360 extends from the anchor block face opening 354*b*. Prior to connecting the terminator 10 to the device 2, the device contact point 362 extends from the device face opening 354*a***.

The plate 20 can be either insulating or conductive. The insulating plate is made of a non-electrically-conductive material, preferably a plastic, so as to not electrically couple the signal contacts 12 and ground contacts 14. A conductive plate is preferably composed of an electrically-conductive metal. The conductive plate electrically couples the ground contacts 14, thus providing more precise impedance matching to the signal contact 12. The signal contact 12 is insulated from the conductive plate by an insulating centering plug.

Figure 26:
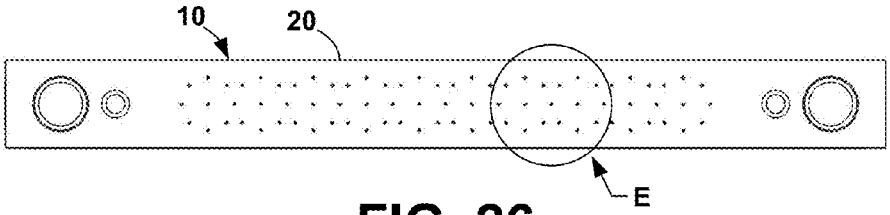
FIG. 26 is bottom view of the cable termination assembly of FIG. 1 with an insulating plate.
Figure 27:
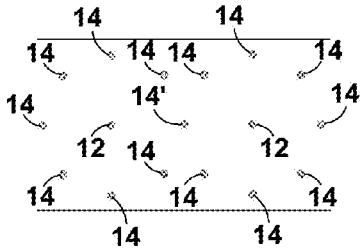
FIG. 27 is a detail view of the bottom of the coax cable termination assembly of FIG. 26 taken at E.

FIGS. 26-28 show the skewed coil compliant contacts 12, 14 with the bottom portion of the ECC of FIGS. 15-17. The skewed coil contact 350 is captured in the through aperture 352. The aperture 352 has a larger center section 356 that narrows to a smaller anchor block opening **354*b* at the side adjacent to the anchor block 18 and to a smaller device opening 354*a* at the other end. The plate 20 has two mirror image sheets 358 where each sheet 358 has one opening 354*a*, 354*b* and a half of the center section 352. Alternatively, the plate 20 has two asymmetrical sheets, one with the full center section 356 and one of the openings 354*a*, 354*b*. The contact 350 is placed in the center section 352 of one sheet 358 and the sheets 358 are sandwiched together to capture the contact 350. The length of the contact leads 360, 362 is such that the leads 360, 362 extend from the openings 354*a*, 354*b***.

FIGS. 29-33 show the conductive rubber compliant contacts 12, 14 with the bottom portion of the ECC of FIGS. 15-17. The conductive rubber contact 250 for the signal contact 12 can be cylindrical with a centrally-located annular depression 256. The non-conductive plate 20 has a through aperture 258 with a centrally-located annular protrusion 260. The rubber contact 250 is radially compressed and placed in the aperture 258 such that the protrusion 260 fits into the depression 256 to retain the contact 250 in the aperture. The length of the contact 250 is such that the ends 262 extend from the plate 20.

The conductive rubber contact for the ground contact 14 can be of the same structure as the signal contact 12. Alternatively, the conductive rubber contact 266 for the ground contact 14 is circular, surrounding the signal contact 12, as in FIGS. 29, 30, and 32. The conductive rubber contact 266 has a circular top sheet 268 adjacent to the anchor block 18 and a circular bottom sheet 270 for interfacing to the device 2. The two sheets 268, 270 are electrically connected by a plurality of plugs 272 in through apertures 274 in the plate 20. The number of plugs 274 can vary by application and is typically four or eight spaced evenly around the signal contact 250. As with the signal contact 250, each plug 272 has an annular depression 276 that fits into an annular protrusion 278 for retention. Knobs 280 extending from the sheets 268, 270 into depressions 282 in the plate 20, as in FIG. 33, help retain the sheets 268, 270 in position.

Skewed coil and conductive rubber contacts are only two forms of compliant contacts contemplated by the present invention. Other forms of compliant contacts and the associated terminators contemplated for use with the present invention are shown and described in Patent Cooperation Treaty publication No. WO2013/063093A1, incorporated herein by reference.

The present invention also contemplates that the signal contact 12 is an element of the ECC 16. An embodiment of such a design 300 is shown in FIGS. 31-34, where the signal contact is a pogo pin that is an element of the ECC. It is a press-fit embodiment with a partial air dielectric, similar to the embodiment of FIGS. 8 and 9. This embodiment 300 has a cylindrical ferrule 302 with an axial bore 304. The bore 304 has several sections. The cable section 306 has a diameter that is adapted to accept a cable 40 with the sheath 48 stripped back, as in FIG. 32. The shield 46 is soldered to the ferrule 302, as at 312.

Figure 34:
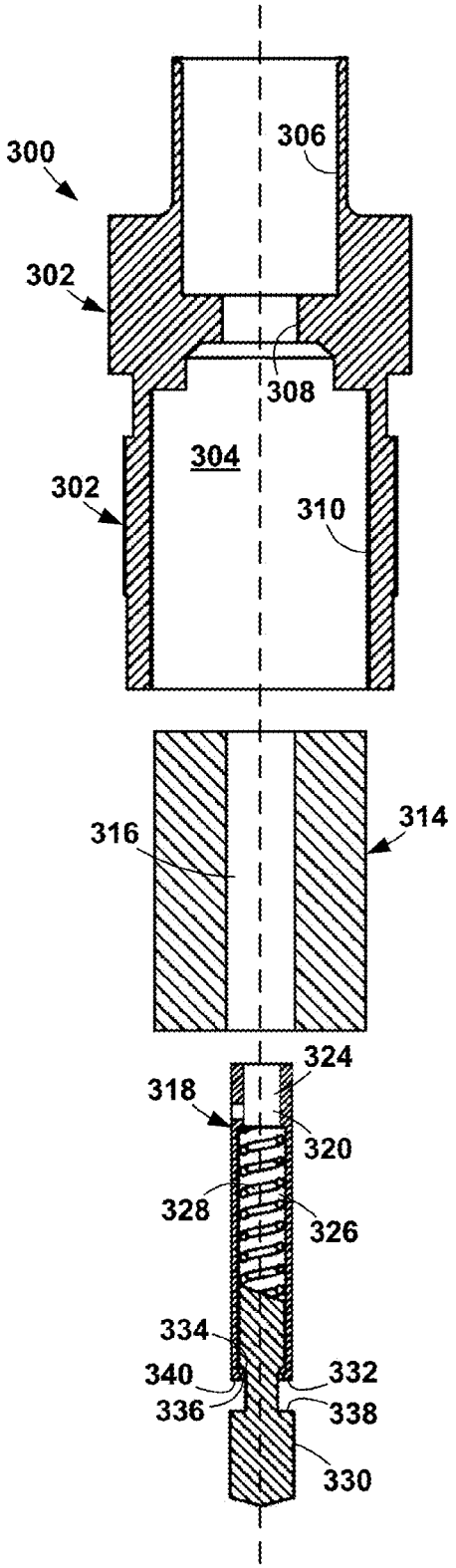
FIG. 34 is an exploded, cross-sectional, side view of the pogo pin embodiment of the expansion/contraction compensator.

The air section 308 is empty but for air and operates as an extension of the cable dielectric 44. As shown in FIG. 34, the center conductor 42 extends through the air section 308. The parameters of the air section 308, primarily the length and diameter, are adjusted to maintain impedance control in a manner known in the art.

The dielectric section 310 is sized to accept a press-fit, axial-aligned, cylindrical dielectric 314. The dielectric 314 operates as an extension of the cable dielectric 44 and air dielectric in the air section 308.

The dielectric 314 has an axial bore 316 for a press-fit center pin 318. The center pin 318 operates as an extension of the cable center conductor 42. The parameters of the dielectric 314 and center pin 318, primarily the lengths and several diameters, are adjusted to maintain impedance control in a manner known in the art.

The center pin 318 has an axial bore 320. The cable section 324 of the bore 320 accepts the cable center conductor 42. A coupling 322 provides the electrical connection between the center conductor 42 and the center pin 318 while accommodating expansion and contraction of the cable center conductor 42 and/or cable dielectric 44. Methods of providing the coupling 322 are described above with reference to the partial air dielectric, press-fit embodiment 60 of the ECC 16.

The spring section 326 of the bore 320 holds a coil spring 328. A pogo pin 330 in the spring section 326 extends from an opening 336 at the bottom of the bore 320. An annular ridge 334 is captured by a shoulder 332 formed by making the opening 336 smaller than the diameter of the spring section 326. The pogo pin 330 can push into the bore 320, compressing the spring 328, until the head 338 of the pogo pin 330 contacts the face 340 of the center pin 318, as in FIG. 33.

Figure 35:
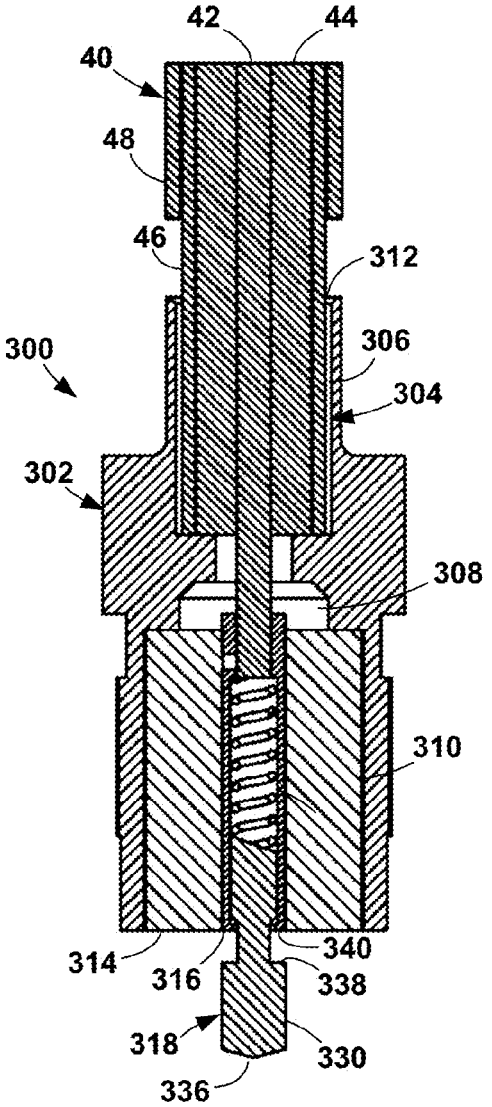
FIG. 35 is a cross-sectional, side view of the embodiment of FIG. 34 assembled with a cable.
Figure 36:
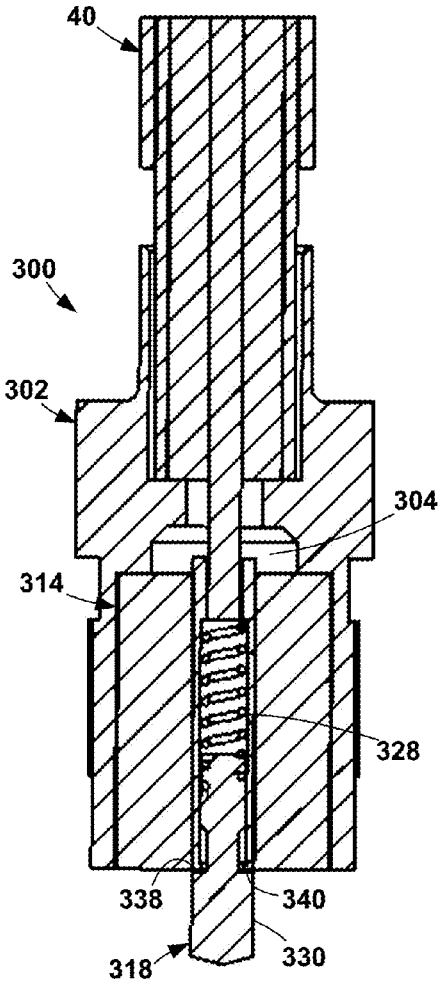
FIG. 36 is a cross-sectional, side view of the embodiment of FIG. 34 assembled with a cable and with the pogo pin compressed.

Although the embodiment of FIGS. 34-36 show the pogo pin incorporated into the ECC embodiment of FIGS. 8 and 9, the present invention contemplates that the pogo pin can be incorporated into any embodiment of the ECC 16.

Figure 37:
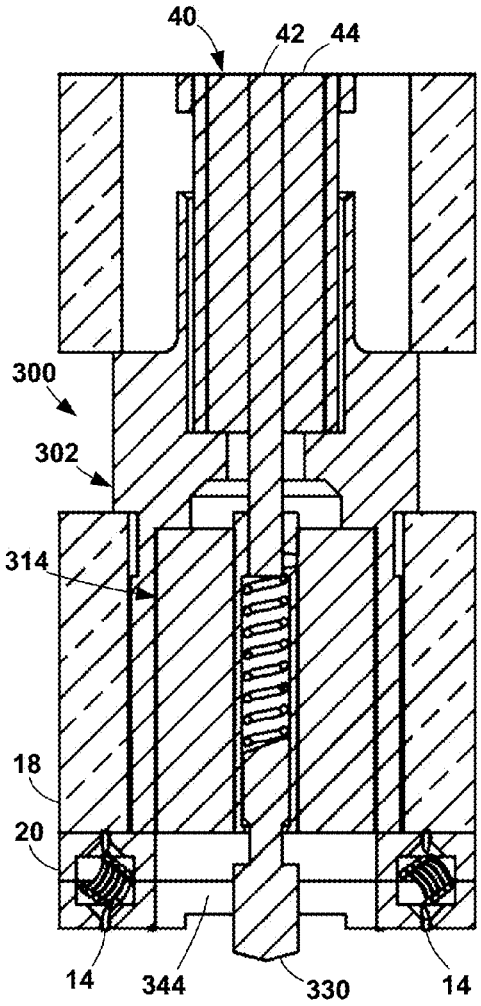
FIG. 37 is a detailed view of FIG. 6 taken at C with the pogo pin embodiment of the ECC and with skewed coil contacts for the ground contacts.

FIG. 37 shows the pogo pin ECC with skewed coil compliant ground contacts 14. The ground contacts 14 surround an opening 344 in the plate 20. The pogo pin 230 extends through the opening 344 and the remainder of the opening 344 is air. The air portion acts as an extension of the cable dielectric 44 to the device 2 and is adjusted to maintain impedance control in a manner known in the art.

Figure 38:
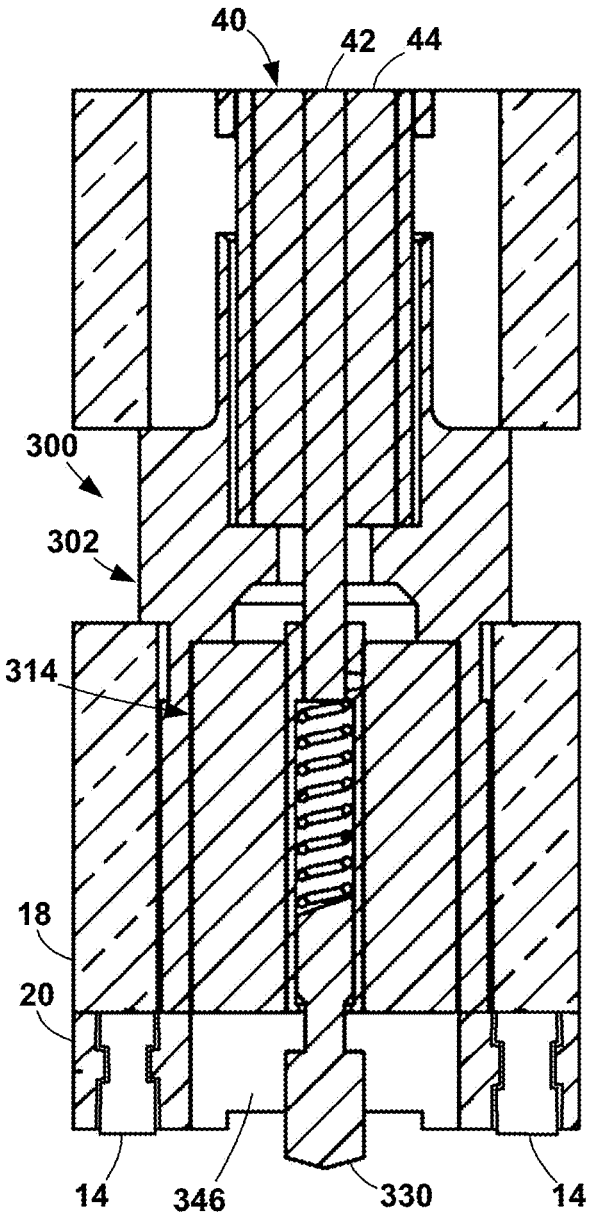
FIG. 38 is a detailed view of FIG. 6 taken at C with the pogo pin embodiment of the ECC and with conductive rubber contacts for the ground contacts.

FIG. 38 shows the pogo pin ECC with a conductive rubber compliant ground contact 14. The conductive rubber contact for the ground contact 14 can be of the same structure as the signal contact 12 described above with reference to FIG. 31. Alternatively, the conductive rubber contact 14 for the ground contact 14 is circular, as described above with reference to FIGS. 29-33. In either configuration, the ground contact(s) 14 surround an opening 346 in the plate 20. The diameter of the opening 346 is adjusted to maintain impedance control in a manner known in art. The pogo pin 230 extends through the opening 346 and the remainder of the opening 346 is air. The air portion acts as an extension of the cable dielectric 44 to the device 2.

Thus it has been shown and described a termination for a controlled-impedance cable with compensation for cable expansion and contraction. Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A controlled-impedance cable termination for a controlled-impedance cable, the cable comprising at least one center conductor, a dielectric surrounding the at least one center conductor, and a ground shield surrounding the dielectric, the termination comprising:

(a) an electrically-insulative anchor block having a face and at least one cable through hole, the cable through hole having an opening in the face;

(b) an electrically-conductive ferrule having a face and a ferrule bore, the ferrule adapted to make electrical contact with the cable ground shield, and the ferrule adapted to be installed in the cable through hole;

(c) a dielectric insert adapted to be installed in the ferrule bore, the dielectric insert having a dielectric insert bore; and (d) an electrically-conductive center pin adapted to be installed in the dielectric insert bore, the center pin having a center pin bore adapted to electrically receive the cable center conductor such that the center conductor can slide in the center pin bore while maintaining electrical contact with the center pin as it expands and contracts, the center pin having a face planar with the ferrule face when installed in the dielectric insert bore.

2. The controlled-impedance cable termination of claim 1 wherein the ferrule, the dielectric insert, and the center pin form an assembly that is removable from the anchor block.

3. The controlled-impedance cable termination of claim 1 further comprising a conductive ground boss adapted to electrically attach to the cable shield, the ground boss adapted to be installed in the ferrule bore where the ground boss makes electrical contact with the ferrule.

4. The controlled-impedance cable termination of claim 1 wherein the ferrule bore includes at least one section of air.

5. The controlled-impedance cable termination of claim 1 further comprising:

(a) a plate having an anchor block face surface adapted to abut the anchor block face and a device surface, the plate having a signal through aperture extending between the anchor block face surface and the device surface, the signal aperture having a signal block opening adjacent to and aligned with the center pin face when the plate is abutted to the anchor block face, the signal aperture having a signal device opening in the device face; and (b) an electrically-conductive compliant signal contact adapted to be captured within the signal aperture, the signal contact having a signal anchor block contact point extending from the signal block opening into electrical contact with the center pin face when the plate is abutted to the anchor block face and a signal device contact point extending from the signal device opening.

6. The controlled-impedance cable termination of claim 5 wherein the plate is composed of an electrically conductive material and the signal aperture is adapted to be captured within an insulating plug in the plate.

7. The controlled-impedance cable termination of claim 5 further comprising:

(a) the plate including a plurality of ground through apertures spaced from and surrounding the signal aperture, each of the ground apertures extending between the anchor block face surface and said device surface, the ground apertures each having a ground block opening in the anchor block face surface and a ground device opening in the device surface; and (b) an electrically-conductive compliant ground contact adapted to be captured within each of the ground apertures, the ground contact, when installed in the ground aperture, having a ground block contact point extending from the ground block opening into electrical contact with the ferrule face and a ground device contact point extending from the ground device opening.

8. A controlled-impedance cable termination for a controlled-impedance cable, the cable comprising at least one center conductor, a dielectric surrounding the at least one center conductor, and a ground shield surrounding the dielectric, the termination comprising:

(a) an electrically-conductive anchor block having a face and at least one ferrule bore, the ferrule bore having an opening in the face, the anchor block adapted to be electrically connected to the cable ground shield;

(b) a dielectric insert adapted to be installed in the ferrule bore, the dielectric insert having a dielectric insert bore; and (c) an electrically-conductive center pin adapted to be installed in the dielectric insert bore, the center pin having a center pin bore adapted to electrically receive the cable center conductor such that the center conductor can slide in the center pin bore while maintaining electrical contact with the center pin as it expands and contracts, the center pin having a face that is planar with the anchor block face when installed in the dielectric insert bore.

9. The controlled-impedance cable termination of claim 8 further comprising a conductive ground boss adapted to electrically attach to the cable shield, the ground boss adapted to be installed in the ferrule bore where the ground boss makes electrical contact with the anchor block.

10. The controlled-impedance cable termination of claim 8 wherein the ferrule bore includes at least one section of air.

11. The controlled-impedance cable termination of claim 8 wherein the anchor block has a cable through hole with an opening in the anchor block face and wherein the ferrule bore is within an electrically-conductive ferrule adapted to be within the cable through hole and adapted to be electrically attached to the cable ground shield, the ferrule having a face that is electrically part of the anchor block face when the ferrule is in the cable through hole.

12. The controlled-impedance cable termination of claim 11 wherein the ferrule, the dielectric insert, and the center pin form an assembly that is removable from the anchor block.

13. The controlled-impedance cable termination of claim 11 wherein the ferrule face is flush with the anchor block face when the ferrule is installed in the cable though hole.

14. The controlled-impedance cable termination of claim 8 further comprising:

(a) a plate having an anchor block face surface adapted to abut the anchor block face and a device surface, the plate having a signal through aperture extending between the anchor block face surface and the device surface, the signal aperture having a signal block opening adjacent to and aligned with the center pin face when the plate is abutted to the anchor block face, the signal aperture having a signal device opening in the device face; and (b) an electrically-conductive compliant signal contact adapted to be captured within the signal aperture, the signal contact having a signal anchor block contact point extending from the signal block opening into electrical contact with the center pin face when the plate is abutted to the anchor block face and a signal device contact point extending from the signal device opening.

15. The controlled-impedance cable termination of claim 14 wherein the plate is composed of an electrically conductive material and the signal aperture is adapted to be captured within an insulating plug in the plate.

16. The controlled-impedance cable termination of claim 14 further comprising:

(a) the plate including a plurality of ground through apertures spaced from and surrounding the signal aperture, each of the ground apertures extending between the anchor block face surface and said device surface, the ground apertures each having a ground block opening in the anchor block face surface and a ground device opening in the device surface; and (b) an electrically-conductive compliant ground contact adapted to be captured within each of the ground apertures, the ground contact, when installed in the ground aperture, having a ground block contact point extending from the ground block opening into electrical contact with the ferrule face and a ground device contact point extending from the ground device opening.

17. A controlled-impedance cable termination assembly comprising:

(a) at least one controlled-impedance cable having at least one center conductor, a dielectric surrounding said center conductor, and a ground shield surrounding said dielectric;

(b) an electrically-insulative anchor block having a face and at least one cable through hole, the cable through hole having an opening in the face;

(c) an electrically-conductive ferrule having a face and a ferrule bore, the ferrule electrically attached to the cable ground shield, and the ferrule installed in the cable through hole;

(d) a dielectric insert in the ferrule bore, the dielectric insert having a dielectric insert bore; and (e) an electrically-conductive center pin in the dielectric insert bore, the center pin having a face planar with the ferrule face and a center pin bore electrically receiving the cable center conductor such that the center conductor can slide in the center pin bore while maintaining electrical contact with the center pin as it expands and contracts.

18. The controlled-impedance cable termination assembly of claim 17 wherein the cable, the ferrule, the dielectric insert, and the center pin form an assembly that is removable from the anchor block.

19. The controlled-impedance cable termination of assembly claim 17 wherein the ferrule bore includes at least one section of air.

20. The controlled-impedance cable termination of assembly claim 17 wherein the cable shield is electrically attached to a conductive ground boss and the ground boss is installed in the ferrule bore where the ground boss makes electrical contact with the ferrule.

21. The controlled-impedance cable termination of assembly claim 17 further comprising:

(a) a plate having an anchor block face surface abutting the anchor block face and a device surface, the plate having a signal through aperture extending between the anchor block face surface and the device surface, the signal aperture having a signal block opening adjacent to and aligned with the center pin face when the plate is attached to the anchor block face, the signal aperture having a signal device opening in the device face; and (b) an electrically-conductive compliant signal contact captured within the signal aperture, the signal contact having a signal anchor block contact point extending from the signal block opening into electrical contact with the center pin face when the plate is attached to the anchor block face and a signal device contact point extending from the signal device opening.

22. The controlled-impedance cable termination assembly of claim 21 wherein the plate is composed of an electrically conductive material and the signal aperture is captured within an insulating plug in the plate.

23. The controlled-impedance cable termination assembly of claim 21 further comprising:

(a) the plate including a plurality of ground through apertures spaced from and surrounding the signal aperture, each of the ground apertures extending between the anchor block face surface and said device surface, the ground apertures each having a ground block opening in the anchor block face surface and a ground device opening in the device surface; and (b) an electrically-conductive compliant ground contact captured within each of the ground apertures, the ground contact having a ground block contact point extending from the ground block opening into electrical contact with the ferrule face and a ground device contact point extending from the ground device opening.

24. A controlled-impedance cable termination assembly comprising:

(a) at least one controlled-impedance cable having at least one center conductor, a dielectric surrounding said center conductor, and a ground shield surrounding said dielectric;

(b) an electrically-conductive anchor block having a face and at least one ferrule bore, the ferrule bore having an opening in the face, the anchor block being electrically attached to the cable ground shield;

(c) a dielectric insert in the ferrule bore, the dielectric insert having a dielectric insert bore; and (d) an electrically-conductive center pin in the dielectric insert bore, the center pin having a center pin bore electrically receiving the cable center conductor such that the center conductor can slide in the center pin bore while maintaining electrical contact with the center pin as it expands and contracts, the center pin having a face that is planar with the anchor block face.

25. The controlled-impedance cable termination assembly of claim 24 wherein the ferrule bore includes at least one section of air.

26. The controlled-impedance cable termination assembly of claim 24 further comprising:

(a) a plate having an anchor block face surface abutting the anchor block face and a device surface, the plate having a signal through aperture extending between the anchor block face surface and the device surface, the signal aperture having a signal block opening adjacent to and aligned with the center pin face, the signal aperture having a signal device opening in the device face; and (b) an electrically-conductive compliant signal contact captured within the signal aperture, the signal contact having a signal anchor block contact point extending from the signal block opening into electrical contact with the center pin face when the plate is attached to the anchor block face and a signal device contact point extending from the signal device opening.

27. The controlled-impedance cable termination assembly of claim 26 wherein the plate is composed of an electrically conductive material and the signal aperture is captured within an insulating plug in the plate.

28. The controlled-impedance cable termination assembly of claim 26 further comprising:

(a) the plate including a plurality of ground through apertures spaced from and surrounding the signal aperture, each of the ground apertures extending between the anchor block face surface and said device surface, the ground apertures each having a ground block opening in the anchor block face surface and a ground device opening in the device surface; and (b) an electrically-conductive compliant ground contact captured within each of the ground apertures, the ground contact having a ground block contact point extending from the ground block opening into electrical contact with the ferrule face and a ground device contact point extending from the ground device opening when installed in the ground aperture.

29. The controlled-impedance cable termination assembly of claim 24 wherein the anchor block has a cable through hole with an opening in the anchor block face and wherein the ferrule bore is within an electrically-conductive ferrule in the cable through hole, the ferrule being electrically attached to the cable ground shield and having a face that is electrically part of the anchor block face.

30. The controlled-impedance cable termination assembly of claim 29 wherein the cable, ferrule, the dielectric insert, and the center pin form an assembly that is removable from the anchor block.

31. The controlled-impedance cable termination assembly of claim 29 wherein the ferrule face is flush with the anchor block face.

32. The controlled-impedance cable termination assembly of claim 29 further comprising a conductive ground boss electrically attached to the cable shield, the ground boss installed in the ferrule bore where the ground boss makes electrical contact with the ferrule.

* * * * *